United States Patent [19]

Gifford et al.

[11] Patent Number: 4,490,983

[45] Date of Patent: Jan. 1, 1985

[54] REGENERATOR APPARATUS FOR USE IN A CRYOGENIC REFRIGERATOR

[75] Inventors: Peter E. Gifford; Stephen D. Swift, both of Syracuse, N.Y.

[73] Assignee: Cryomech Inc., Syracuse, N.Y.

[21] Appl. No.: 537,030

[22] Filed: Sep. 29, 1983

[51] Int. Cl.[3] ..... F25B 9/00

[52] U.S. Cl. ..... 62/6; 62/298; 165/76

[58] Field of Search ..... 62/6, 298; 165/76

[56] References Cited

U.S. PATENT DOCUMENTS 2,906,101 9/1959 McMahon et al. ..... 62/6

3,312,072 4/1967 Gifford ..... 62/6

4,398,398 8/1983 Wheatley et al. ..... 62/6

*Primary Examiner*—Ronald C. Capossela

*Attorney, Agent, or Firm*—Bruns and Wall

[57] ABSTRACT

A regenerator unit arranged for mounting in the flow circuit carrying a refrigerant (helium gas) between stages of a two-stage Gifford-McMahon cryorefrigerator. The unit is housed in a sleeve extending between the expansion chamber of the first stage and the low temperature heat exchanger. A locking mechanism both suspends and seals the regenerator within the sleeve so that the regenerator cannot move either axially or radially and refrigerant cannot bypass the unit. The locking mechanism makes assembling and disassembling the unit in the refrigerator readily simple.

9 Claims, 4 Drawing Figures

REGENERATOR APPARATUS FOR USE IN A CRYOGENIC REFRIGERATOR

BACKGROUND OF THE INVENTION

This invention relates generally to a second stage regenerator suitable for use in a multistage cryogenic refrigerator.

A refrigeration cycle generally referred to as the Gifford-McMahon cycle is disclosed in U.S. Pat. No. 2,906,101. The cycle is further shown embodied in a two-stage refrigerator in a later U.S. Pat. No. 3,312,072. This two-stage arrangement has found relatively wide use in a number of different cryogenic applications. In the two-stage configuration, a pair of different size expansion chambers are utilized to process a working substance in the form of helium gas to attain extremely low temperatures. Each chamber houses a sealed displacer that is able to slide axially in the chamber to vary its volume. The helium is initially compressed to a high pressure and is cycled through the chambers under the control of a rotary valve.

The expansion chambers, which generally define the two stages of refrigeration, are interconnected by a refrigerant flow circuit containing a low temperature heat exchanger and second stage regenerator unit. The regenerator is typically a small, high efficiency unit that is operatively connected between the first stage expansion chamber and the low temperature heat exchanger. The pressure loss over the regenerator is minimized so that the pressure in both chambers remains substantially equal throughout the cycle. The unit is normally housed within a sleeve and is packed with fine lead shot. The lead shot, which can retain its specific heat at low temperatures, serves to remove the heat of refrigeration from the helium gas as it moves in one direction toward the second stage and to give back the heat to gas as it moves in the opposite direction.

The sleeve and the regenerator housing that is enclosed therein are fabricated from different materials. As a consequence, the two members expand and contract at different rates when exposed to the large temperature changes (295° K. -7° K.) that take place in this critical region. Any thermal displacement of the regenerator within the sleeve, no matter how slight, can cause unwanted heat producing friction to be developed in the low temperature region and also upset the volumetric relationship between stages. In any event, unwanted movement of the regenerator within the sleeve will adversely affect the performance of the refrigerator as well as its operating efficiency.

To prevent the second stage regenerator from moving in assembly, it has heretofore been the practice to press fit the regenerator housing tightly into the sleeve using an interference fit. It has been found, however, that under even an extremely tight fit, the regenerator can free itself from the sleeve under actual working conditions and begin to move axially in the sleeve in response to the movement of refrigerant therethrough. Part of the problem resides in the fact that the regenerator housing, which is made from a glass woven fabric is initially expanded outwardly in a radial direction by the tightly packed shot. After being exposed to a number of refrigeration cycles, the shot is redistributed in the housing and the housing is thus permitted to contract back to its normal size. The effectiveness of the press fit is thus lost whereupon the regenerator is able to work itself loose from the retaining sleeve. Beyond unwanted displacement of the unit, this can also destroy the seal between the unit and the sleeve whereupon refrigerant can "blow by" the regenerator causing further problems.

From a manufacturing standpoint, press fitting the second stage regenerator into the enclosing sleeve creates further problems. Because of the tightness of the fit, extreme care must be taken when assembling or disassembling the unit to insure that its component parts are not broken or damaged. The procedures involved in assembling and/or disassembling a unit are complex, time consuming and costly. It is difficult to ascertain if the regenerator unit is properly positioned in relation to the low temperature heat exchanger during assembly and there is some likelihood that an unwanted gap might be left between the two units which will alter the geometry of the system and adversely affect performance and efficiency. Because of the lack of readily interchangeable parts, the replacement of a regenerator unit must be performed by a highly qualified technician.

SUMMARY OF THE INVENTION

It is therefore an object of the present invention to improve cryogenic refrigerators.

It is also an object of the present invention to insure that the second stage regenerator unit utilized in a two-stage Gifford-McMahon refrigerator does not move during normal operations.

A still further object of the present invention is to eliminate the need to tightly press fit the second stage regenerator unit of a two-stage Gifford-McMahon refrigerator into its receiving sleeve.

Another object of the invention is to provide for greater ease of assembly and disassembly of a regenerator unit from an enclosing sleeve as typically found in a multi-stage refrigerator employing the Gifford-McMahon cycle.

Yet another object of the present invention is to improve the performance and efficiency of a multi-stage Gifford-McMahon refrigerator.

Still another object of the present invention is to provide an interstage regenerator for use in a multi-stage cryogenic refrigerator that is capable of accepting the effects of thermal stress without moving or breaking the seal about the regenerator unit.

These and other objects of the present invention are attained in a multi-stage Gifford-McMahon refrigerator having at least two staged expansion chambers for processing a helium gas refrigerant. An expanded surface low temperature heat exchanger and a regenerator are connected in a series flow circuit between the two expansion chambers to establish a flow path for the refrigerant moving therebetween. The regenerator is loosely contained within a sleeve by means of a locking mechanism that prevents the unit from moving either radially or axially when exposed to stress produced under actual working conditions. A deformable seal is also provided that acts in association with the locking mechanism to prevent refrigerant from blowing by the regenerator.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
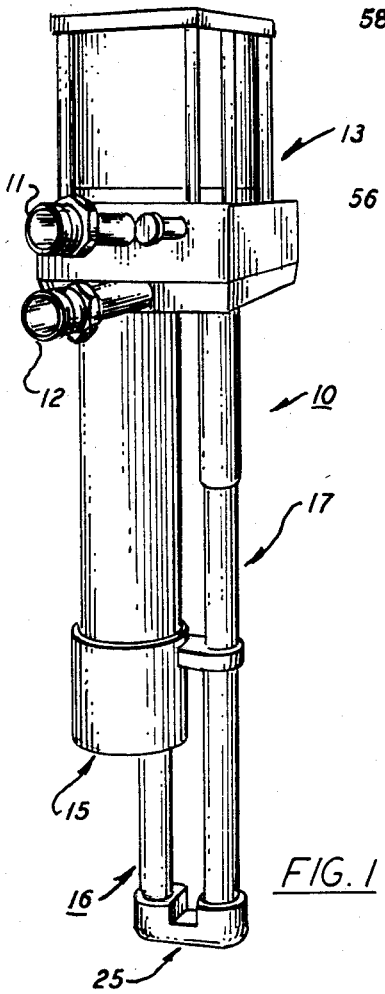
FIG. 1 is a perspective view of a cryogenic refrigerator embodying the teachings of the present invention.
Figure 4:
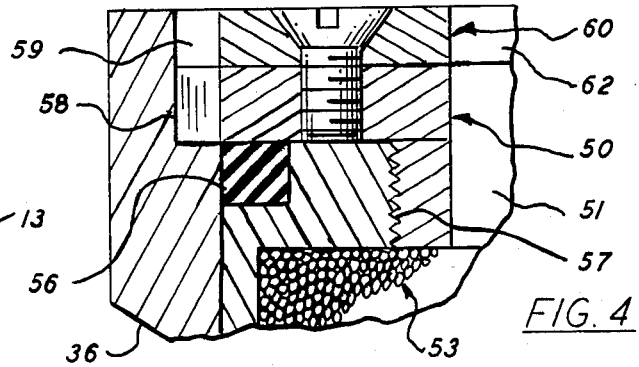
FIG. 4 is a further enlarged partial view end section further showing the upper section of the second stage regenerator unit containing the locking mechanism.
Figure 3:
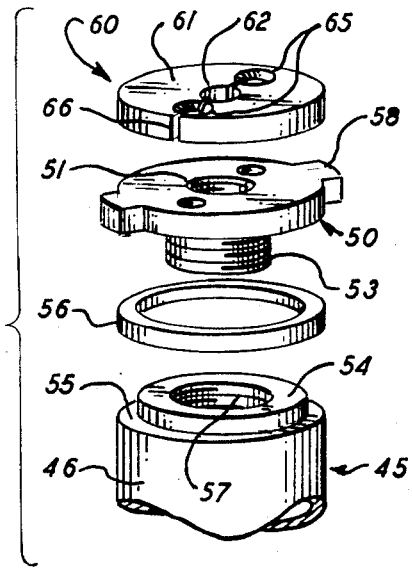
FIG. 3 is an exploded perspective view of an expandable locking mechanism used to suspend the regenerator unit within an enclosing sleeve.

Turning now to the drawings and, in particular to FIG. 1, there is illustrated a two-stage cryogenic refrigerator that utilizes the Gifford-McMahon cycle and which embodies the teachings of the present invention. The refrigerator is generally referenced 10 and includes a first expansion chamber 20 contained in the first refrigeration stage 15 and a second smaller expansion chamber 23 contained in the second refrigeration stage 17. Although not shown in the drawings, the refrigerator is connected to a compressor via an inlet connector 11 and an outlet connector connector 12. Helium gas, which is the working substance used in the present system, is provided from the discharge side of the compressor at about 300 psig and is exhausted to the suction side of the compressor at about 60 psig. The refrigerator has a first stage cooling capacity to about 25° K. and a second stage cooling capacity to about 7° K.

As is explained in greater detail in the previously noted U.S. Pat. No. 3,312,072, which issued to W. E. Gifford, a rotary control valve is used in the system as both a timing device and as a means for regulating the flow of refrigerant gas through the multiple stages. The valve is driven at a predetermined speed by means of an electric motor 13 that is housed in the upper section of the refrigerator. To the extent necessary to understand the operation of the rotary valve and to more thoroughly understand the refrigeration cycle, the disclosure contained in the noted Gifford patent is herein incorporated by reference. Following the teachings found in the Gifford patent, helium gas at a high pressure is initially delivered in series to both of the refrigerant stages to raise the gas pressure. The expansion chamber of the first stage is controlled by a free floating sealed displacer 18 that permits the volume of the chamber to be varied while the second stage contains a similar smaller diameter piston 22 that operates to vary the volume of chamber 23. The two chambers are interconnected by means of a regenerator unit 45 and an extended surface heat exchanger unit 25 that are mounted in series therebetween. After the second stage chamber has reached its maximum volume, the control valve is cycled to permit the cold high pressure gas to be exhausted into the heat exchanger unit to provide the desired final refrigeration effect bringing the temperature in this region to about 7° K. The gas is now passed back through the regenerator where it picks up the heat energy stored therein before being returned through the valve to the compressor.

The low temperature heat exchanger unit 25 forms the cold head of the refrigerator and generally includes a hollow manifold section 28 of U-shaped construction and a heat exchanger, generally referenced 30. An opening 29 passes through the unit and provides a flow path by which the helium gas flows between stages. The heat exchanger itself is mounted in a recess 35 located on the first stage side of the manifold. The exchanger consists of a series of stacked perforated plates 31—31 which are separated by interposed wire spacers 32—32. The spacers are typically formed in a G-like configuration and are placed between the plates to support them in spaced apart parallel alignment within the recess. An expanded circular opening 42 is formed in coaxial alignment with the recess that houses the heat exchanger and is adapted to receive a sleeve 35 therein. In practice the sleeve is bottomed in the opening 42 directly over the heat exchanger and is joined to the manifold using any suitable means for creating a leak tight joint therebetween.

Figure 2:
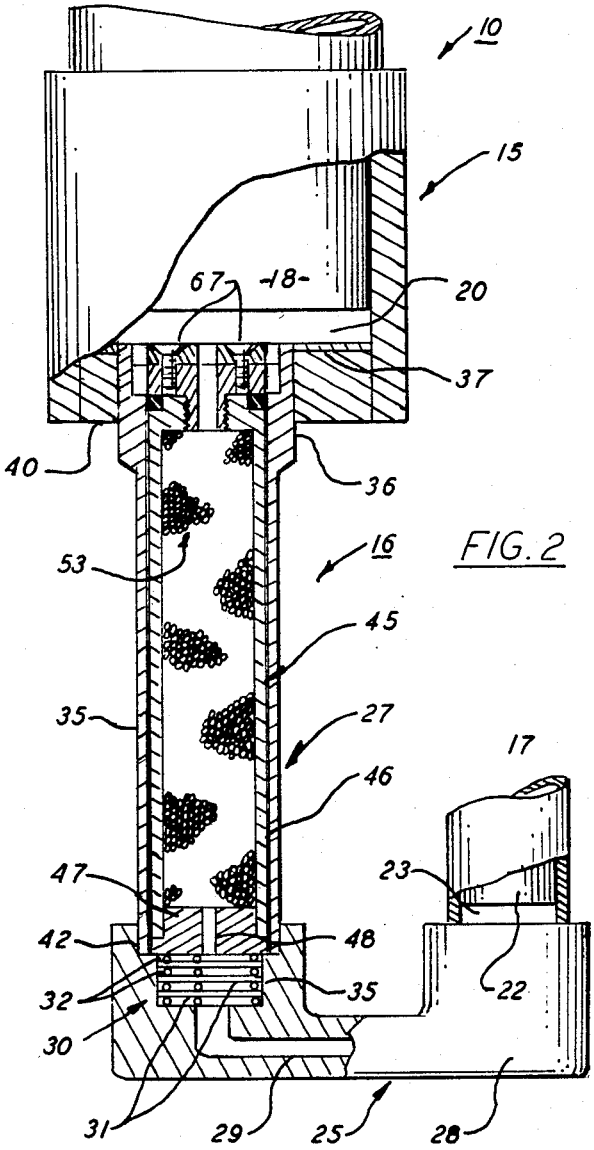
FIG. 2 is an enlarged partial view of a second stage regenerator unit utilized in the refrigerator illustrated in FIG. 1 having portions broken away to more clearly show the component parts thereof.

The opposite end of the sleeve is similarly joined to the bottom wall 40 of the first stage expansion chamber. This end of the sleeve contains an enlarged hub section 36 that supports a radially disposed flange 37. The flange is secured in a complimentary groove formed in the top of wall 40 and, as illustrated in FIG. 2, forms an entrance to the regenerator unit 45.

The second stage regenerator unit 45 is slidably contained within the sleeve 27. The unit includes an elongated cylindrical housing 46 that is typically formed of a woven glass material. The bottom of the housing is closed by a copper plug 47 having high thermal conductivity which is tightly fitted into the housing and secured in place by means of screws or the like. In assembly, the plug is bottomed in the opening formed in the top of the manifold 28 to position the regenerator directly over the heat exchanger 30. A hole 48 passes through the plug to allow refrigerant to pass freely between the regenerator and the heat exchanger. Clearance is provided between the outer periphery of the regenerator housing and the inner wall of the sleeve to permit the regenerator unit to be easily inserted into the sleeve and securely bottom in the manifold. The clearance is also sufficient to permit the housing to contract and expand freely without binding or rubbing against the sleeve thereby eliminating unwanted friction heating in this critical low temperature region. As previously noted, the regenerator housing is tightly packed with fine lead shot capable of retaining its specific heat at the low operating temperatures. Accordingly, the shot is able to extract heat from refrigerant passing from the first stage into the second stage and return the extracted heat to refrigerant moving in the opposite direction.

The top of the regenerator housing contains a threaded opening 57 therein into which the shank 53 of end cap 50 is turned. The end cap, in assembly, is threaded against the top surface 54 of the regenerator housing. A recessed shoulder 55 is formed in the outer periphery of this top surface and a deformable gasket 56 is fitted into the recess. In assembly, the gasket is compressed between the end cap and the regenerator housing so that it is deformed radially into sealing contact against the sleeve to provide a fluid tight seal therebetween. The seal prevents refrigerant from moving between the regenerator and the sleeve and thus forces refrigerant in motion to pass through the regenerator.

The threaded end cap 50 also includes a pair of radially disposed locking lugs 58—58 that are slidably received with a pair of coacting L-shaped guideways formed in the upper hub of the sleeve. The guideways are formed so that the vertical groove of each passes downwardly from the top of the sleeve to a predetermined depth. The horizontal groove of the guideway then passes circumferentially along the sleeve wall and is inclined slightly in a downward direction. The lugs are passed into the vertical legs and bottomed therein to position the bottom plug of the attached regenerator directly over the heat exchanger. Turning the end cap in the circumferential direction causes the lugs to pass into the horizontal grooves thus driving the bottom wall into locking contact against the low temperature manifold. Accordingly, negative volume is maintained between the regenerator and the low temperature heat exchanger.

A radially expandable hanger 60 is also passed into the top opening of the sleeve and is placed in seating contact against the top surface of the threaded end cap 50. The hanger is basically a split collar 61 having a centrally located flow port 62 that communicates directly, in assembly, with the flow port 51 formed in the end cap to permit working fluids to move freely between the first stage expansion chamber and the regenerator unit. The split collar further includes a pair of countersunk holes 65-65 which lie upon a common radially disposed centerline passing through the center of the flow port 52. A slotted opening 66 is cut along this line so that it passes through both of the countersunk holes as well as the central port thus allowing the collar to be easily expanded in a radial direction.

In assembly, a pair of flat-head screws 67—67 (FIG. 2) are passed through the countersunk holes formed in the collar and are threaded into coaligned receiving holes 68—68 tapped in the threaded cap. The normally unexpanded outer diameter of the collar forms a close running fit with the inner wall of the sleeve so that when the hanger is placed over the end cap in assembly, there exists a very slight clearance between the outer periphery of the collar and the inner wall of the sleeve. As the screws are tightened down in assembly, the collar expands radially into locking contact against the inner wall of the sleeve to secure the regenerator housing inside the sleeve. As noted, sufficient clearance is furnished between the outside diameter of the housing and the inside diameter of the sleeve to permit the housing to thermally deform within the sleeve when exposed to the extreme changes in temperatures that take place in this region during normal machine operations.

As should now be evident, the regenerator unit of the present invention can be easily slipped into and out of the enclosing sleeve to provide greater ease of assembly and interchangeability of parts for maintenance purposes. In practice, the split collar and the sleeve are both formed of the same material. Accordingly, a uniform locking force is exerted by the collar on the sleeve at all times thereby preventing movement of the regenerator under changing thermal conditions. The locking lugs also serve to bottom the regenerator unit against the heat exchanger thus further preventing axial displacement of the unit.

While this invention has been described with specific reference to the structure disclosed herein, it is not necessarily confined to the details as set forth and this application is intended to cover all modifications and changes that may come within the scope of the following claims.

We claim:

1. In a multi-stage Gifford-McMahon refrigerator having sealed displacers slidably mounted in the expansion chamber of each stage, a flow circuit for operatively connecting the expansion chamber of the first stage with the expansion chamber of the second stage that includes a low temperature heat exchanger that forms part of the cold head of the refrigerator, a hollow sleeve for connecting the low temperature heat exchanger to the expansion chamber of the said first stage, a regenerator unit loosely received within the said hollow sleeve, a locking means secured to the regenerator unit, said locking means being operable to forceably expand radially into locking engagement with the inner wall of the said sleeve to prevent the regenerator from moving inside the sleeve, said locking means and said sleeve means being formed of material having about the same thermal coefficient of expansion whereby the locking means exerts a substantially uniform holding force against the sleeve as the cojoined members are subjected to changes in temperature, and a sealing means positioned between the locking means and the regenerator unit that is deformable into sealing contact with the sleeve to prevent refrigerant from moving therebetween.

2. The refrigerator of claim 1 wherein the regenerator unit further includes a housing that it tightly packed with fine lead shot.

3. The refrigerator of claim 2 wherein said locking means further includes a radially expandable collar that is secured to the top of said regenerator housing, and means for expanding the collar into locking contact against the wall of the enclosing sleeve.

4. The refrigerator of claim 1 that further includes a seating means to axially position the regenerator unit in the sleeve so that the bottom wall of the unit is held in abutting contact against the low temperature heat exchanger.

5. The refrigerator of claim 4 wherein the bottom wall of the regenerator is formed of a material having high thermal conductivity and the wall is seated in a receiving opening formed in the low temperature heat exchanger.

6. The refrigerator of claim 2 wherein said expandable collar is a split ring having threaded means associated therewith for expanding the ring outwardly in a radial direction.

7. In a two-stage refrigerator of the type having a first expansion chamber and a second expansion chamber that are interconnected by a regenerator unit and a low temperature heat exchanger, the method of mounting the regenerator unit in the said refrigerator that includes the steps of connecting one end of a hollow sleeve to the entrance of the low temperature heat exchanger, loosely fitting a regenerator unit into the sleeve, bottoming the regenerator unit into contact against the heat exchanger, securing an expandable ring to the top of the regenerator unit, expanding the ring into locking engagement with the inside wall of the sleeve with sufficient force to prevent movement of the regenerator within the sleeve, and connecting the opposite end of the sleeve to one of the said expansion chambers.

8. The method of claim 7 that further includes the step of positioning a deformable seal between the expandable ring and the regenerator unit and deforming the seal into leak tight contact against the inner wall of the sleeve to prevent refrigerant from moving therebetween.

9. The method of claim 7 that includes the further step of biasing the bottom surface of the regenerator unit against the heat exchanger to further prevent axial movement of the unit.

* * * * *